United States Patent [19]

Miura

[11] Patent Number: 4,572,880

[45] Date of Patent: Feb. 25, 1986

[54] METHOD OF MANUFACTURING FLUORESCENT SCREENS

[75] Inventor: Kiyoshi Miura, Mobara, Japan

[73] Assignee: Hitachi, Ltd., Tokyo, Japan

[21] Appl. No.: 254,308

[22] Filed: Apr. 15, 1981

Related U.S. Application Data

[63] Continuation of Ser. No. 87,022, Oct. 22, 1979.

[30] Foreign Application Priority Data

Oct. 25, 1978 [JP] Japan ..... 53-130554

[51] Int. Cl.[4] ..... G03C 5/00

[52] U.S. Cl. ..... 430/25; 430/6; 430/23; 430/326

[58] Field of Search ..... 430/25, 6, 23, 326

[56] References Cited

U.S. PATENT DOCUMENTS 3,558,310 1/1971 Mayaud ..... 430/25
3,615,460 10/1971 Lange et al. ..... 430/25
3,632,339 1/1972 Kham ..... 430/25
3,661,580 5/1972 Mayaud ..... 430/25
3,778,266 12/1973 Mizuno et al. ..... 430/25

*Primary Examiner*—Jack P. Brammer
*Attorney, Agent, or Firm*—Charles E. Pfund

[57] ABSTRACT

A fluorescent screen of a black matrix type color picture tube is manufactured by forming a graphite film on an inner surface of a face plate, applying a photoresist film on the graphite film, exposing to light portions of the photoresist film where phosphor picture elements are to be formed subsequently, removing the exposed portions of the photoresist film to expose portions of the graphite film, removing the exposed portions of the graphite film to form a black matrix film having voids corresponding to the exposed portions of the graphite film, and thereafter depositing triads of phosphors of picture elements on the inner surface of the face plate through the voids. In a modification, a reflective film is interposed between the graphite film and the photoresist film and portions of the reflective film in register with portions of the photoresist film exposed to light are removed by etching.

8 Claims, 5 Drawing Figures

METHOD OF MANUFACTURING FLUORESCENT SCREENS

This is a continuation of application Ser. No. 06-087,022 filed 10-22-74.

BACKGROUND OF THE INVENTION

This invention relates to a method of manufacturing a fluorescent screen, more particularly a simplified method of manufacturing a black matrix type fluorescent screen.

Generally, a black matrix type fluorescent screen of a color picture tube comprises picture elements of phosphors which luminesce in green (G), blue (B) and red (R) colors and are regularly arranged in stripe or dot triad pattern. These fluorescent picture elements are formed by photo-printing technique utilizing a photo or light-hardenable property of an ordinary photosensitive resin. More particularly, according to this method which is disclosed in U.S. Pat. No. 3,558,310 of RCA, for example, a light-hardenable type photoresist is coated on the inner wall surface of the panel of the color picture tube, and portions of the photoresist is exposed to light from a spot or linear light-source through a shadow mask such that the light will impinge upon the portions of the photoresist where the triads of phosphors are to be formed. For the purpose of approximating the locus of the electron beam to that of the exposure light, the light source is positioned at a site corresponding to the deflection center of the electron beams and a correction lens made of glass or plastics is positioned between the light source and the shadow mask. When the photoresist is developed after light exposure, the exposed portions thereof rendered hard and insoluble in a solvent due to crosslinking reaction caused by light remain to form a pattern of layers of hardened photoresist on the inner wall surface of the panel at predetermined positions. A light absorbing substance such as graphite is then coated on the surface of the photoresist layers and at voids corresponding to unexposed portions of the photoresist, dried and then treated with an oxidizing agent, hydrogen peroxide for example, to peel off the graphite films coated on the surfaces of the hardened photoresist layers together with these layers, leaving behind a pattern of black matrix. Thereafter, dots or stripes of the three color phosphors are formed on portions other than the black matrix pattern, say, corresponding to the exposed portions by conventional slurry or dusting technique.

The method of manufacturing a fluorescent screen described above is complicated and includes a number of process steps including wet coating, washing with water, development and drying, thus increasing the cost of manufacturing. Moreover, such chemicals as hydrogen peroxide are used in the etching step so that it is necessary to carefully and safely handle them.

SUMMARY OF THE INVENTION

Accordingly, it is an object of this invention to provide an improved method of manufacturing a black matrix type fluorescent screen of a color picture tube capable of eliminating various defects described above and simplifying the process steps.

According to this invention, there is provided a method of manufacturing a fluorescent screen of a black matrix color picture tube, comprising the steps of forming a graphite film on an inner surface of a panel of the color picture tube, applying a photoresist film on the graphite film, exposing to light portions of the photoresist film where phosphor picture elements are to be formed subsequently, removing the exposed portions of the photoresist film to expose portions of the graphite film, and then removing the exposed portions of the graphite film to form a pattern of black matrix film corresponding to unexposed portions of the photoresist film. Three color phosphor picture elements are deposited on the inner surface of the face plate at voids corresponding to the exposed portions of the graphite film.

In a modified embodiment, a reflective film is interposed between the graphite film and the photoresist film to improve brightness. Portions of the reflective film underlying the portions of the photoresist film exposed to light are removed by etching.

DESCRIPTION OF THE PREFERRED EMBODIMENTS

Figure 1A:
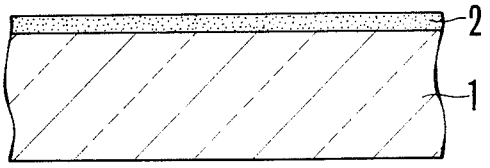
FIGS. 1A through 1D are partial sectional views useful to explain various steps of the method of manufacturing a fluorescent screen according to this invention.
Figure 1B:
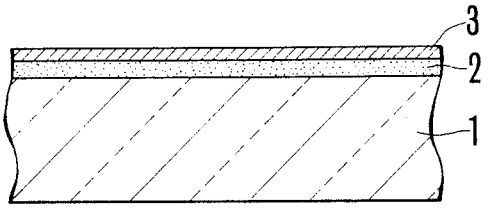
Figure 1C:
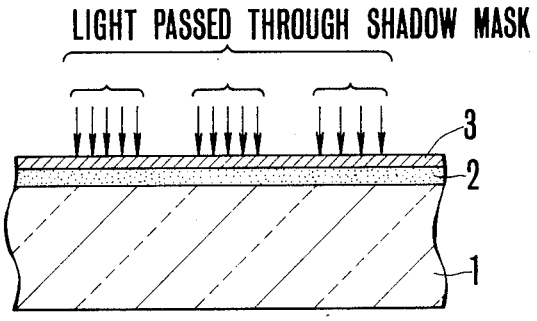
Figure 1D:
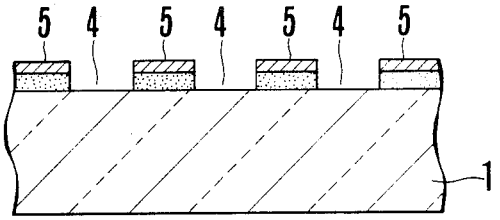

Referring now to FIGS. 1A through 1D, a panel 1 of a color picture tube is washed, a graphite slurry is coated on the inner surface of the panel, and then dried to form a graphite film 2 as shown in FIG. 1A. It is advantageous that the bonding force of the graphite film 2 to the panel surface is not so strong. A graphite film soluble in water or alkaline solution is most suitable. For example, it is advantageous to use water glass as a binder or to add a small quantity of CMC (sodium carboxy methyl cellulose) or Hitasol (trade name) manufactured by Hitachi Funmatsu Yakin Kaisha in Japan. Then, a positive type photoresist is coated on the graphite film and then dried to form a photoresist film 3 as shown in FIG. 1B. As the photoresist may be used those sold by Kodak Co., Shipley Co. and Fuji Yakuhin Kabushiki Kaisha in Japan. All of these photoresists are soluble in organic solvents so that even if the graphite film 2 is soluble in water, the graphite film would not peel off at the time of coating the photoresist. Then a shadow mask, not shown, is used to expose to light, as shown in FIG. 1C, portions of the photoresist film on which three color phosphor picture elements are to be formed subsequently. Then, the photoresist film is developed with an aqueous solution of an alkali, for example, sodium hydroxide to dissolve and remove portions of the photoresist film exposed to light, thus exposing the portions of the graphite film 2 underlying the removed portions of the photoresist film. By continuing development, these portions of the graphite film 2 in register with the exposed portions of the photoresist film are removed to form openings or voids 4 as shown in FIG. 1D, thus forming a black matrix film 5 having a predetermined pattern. Where the bonding force between the graphite film 2 and the surface of the glass panel is so strong that the graphite film can not be readily removed by using water for development, the graphite film at the exposed portions can be readily peel off by dipping the assembly in a dilute hydrofluoric acid after development. Alternatively, an organic substance, for example, a polyvinyl alcohol may be applied to a small thickness prior to the coating of the graphite slurry on the surface of the panel so as to make it possible to readily peel off the graphite film with developing water.

Since this method of preparation eliminates etching and drying steps, the process steps are greatly simplified. Moreover, since the etching step has been eliminated, corrosion and explosion caused by the use of peroxides can be avoided.

Figure 2:
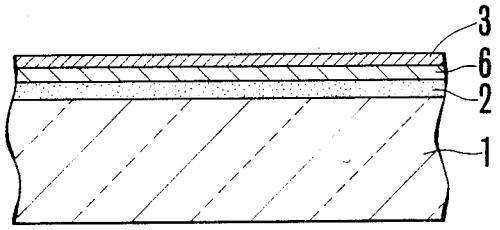
FIG. 2 is a partial sectional view showing a modified embodiment of this invention.

FIG. 2 shows a modified method of this invention in which elements corresponding to those shown in FIGS. 1A through 1D are designated by the same reference numerals. According to this modification, after the graphite film 2 has been coated on the surface of the panel, a reflective film 6 made of a material having high reflectivity such as aluminum, alumina, or titanium oxide is deposited on the graphite film 2 by vapor deposition or rotary coating technique. Then, a positive type photoresist is coated on the reflective film 6 and dried to form a photoresist film 3. Thereafter, by the same process steps as in the foregoing embodiment, portion of the photoresist film which have been exposed to light are dissolved and removed to expose the reflective film underlying these portions. Then the portions of the reflective film 6 and the graphite film 2 are removed by etching and development, thus forming a black matrix film 5 with openings 4. Sodium hydroxide solution is preferably used as etchant for this purpose.

With this modified method, since the reflective film 6 is formed beneath the black matrix film 5, it is possible to improve the brightness of the fluorescent screen.

As described above, according to this invention, it is possible to manufacture a fluorescent screen of a color picture tube through simplified process steps.

What is claimed is:

1. A method of forming a black matrix film on an inner surface of a panel of a color picture tube for receiving phosphor picture elements of different colors at predetermined locations to form a fluorescent screen, consisting of the steps of forming a graphite film on an inner surface of a panel of said color picture tube, forming a reflective film on said graphite film, forming a positive type photoresist film on said reflective film, said positive type photoresist film being insoluble in an aqueous solution of an alkali when not exposed to light but made soluble in said aqueous solution of an alkali upon exposure to light, exposing to light portions of said photoresist film where said phosphor picture elements of different colors are to be formed subsequently, removing said exposed portions of said photoresist film by means of an aqueous solution of an alkali to expose portions of said reflective film, and then removing said exposed portions of said reflective film and portions of said graphite film underlying the same to form a pattern of black matrix film corresponding to unexposed portions of said photoresist film with voids therein at predetermined locations corresponding to the exposed portions of said photoresist film.

2. The method according to claim 1 wherein said exposed portions of said reflective film are removed with an etching solution.

3. The method according to claim 1 wherein said graphite film is formed from a mixture of graphite and a binder selected from the group consisting of water glass and sodium carboxy methyl cellulose.

4. The method according to claim 1 wherein said exposed portions of said graphite film are removed with a hydrofluoric acid solution.

5. The method according to claim 1 wherein said reflective film is formed from a composition selected from the group consisting of aluminum, aluminum oxide and titanium oxide.

6. The method according to claim 2 wherein said etching solution is sodium hydroxide.

7. A method of forming a black matrix film on an inner surface of a panel of a color picture tube for receiving phosphor picture elements of different colors at predetermined locations to form a fluorescent screen, consisting of the steps of applying a film of polyvinyl alcohol to an inner surface of a panel of said color picture tube, forming a graphite film on said polyvinyl alcohol film, applying a positive type photoresist film on said graphite film, said positive photoresist film being insoluble in an aqueous solution of an alkali when not exposed to light but made soluble in said aqueous solution of an alkali upon exposure to light, exposing to light portions of said photoresist film where said phosphor picture elements of different colors are to be formed subsequently, removing said exposed portions of said photoresist film by means of an aqueous solution of an alkali to expose portions of said graphite film, and then removing said exposed portions of the graphite film to form a pattern of black matrix film corresponding to unexposed portions of said photoresist film with voids therein at predetermined locations corresponding to the exposed portions of said photoresist film.

8. A method of forming a black matrix film on an inner surface of a panel of a color picture tube for receiving phosphor picture elements of different colors at predetermined locations to form a fluorescent screen, consisting of the steps of applying a film of polyvinyl alcohol to an inner surface of a panel of said color picture tube, forming a graphite film on said polyvinyl alcohol film, forming a reflective film on said graphite film, forming a positive type photoresist film on said reflective film, said positive type photoresist film being insoluble in an aqueous solution of an alkali when not exposed to light but made soluble in said aqueous solution of an alkali upon exposure to light, exposing to light portions of said photoresist film where said phosphor picture elements of different colors are to be formed subsequently, removing said exposed portions of said photoresist film by means of an aqueous solution of an alkali to expose portions of said reflective film, and then removing said exposed portions of said reflective film and portions of said graphite film underlying the same to form a pattern of black matrix film corresponding to unexposed portions of said photoresist film with voids therein at predetermined locations corresponding to the exposed portions of said photoresist film.

* * * * *